US005762479A

United States Patent [19]

Baars et al.

[11] Patent Number: 5,762,479

[45] Date of Patent: Jun. 9, 1998

[54] DISCHARGE ARRANGEMENT FOR A HERMETIC COMPRESSOR

[75] Inventors: Edemar Baars; Edson Correa Miguel, both of Joinville - SC, Brazil

[73] Assignee: Empresa Brasileira De Compressores S/A - Embarco, Joinville - SC, Brazil

[21] Appl. No.: 790,975

[22] Filed: Jan. 30, 1997

[30] Foreign Application Priority Data

Feb. 1, 1996 [BR] Brazil ..... 9600527-0

[51] Int. Cl.[6] ..... F04B 39/00

[52] U.S. Cl. ..... 417/312; 417/902; 181/403

[58] Field of Search ..... 417/312, 902, 417/540; 181/403

[56] References Cited

U.S. PATENT DOCUMENTS

| | | | |
|---|---|---|---|
| 3,820,921 | 6/1974 | Thayer | 417/312 |
| 4,231,228 | 11/1980 | Galvin et al. | 417/312 |
| 4,642,035 | 2/1987 | Nyquist | 417/312 |
| 4,923,374 | 5/1990 | Lundin et al | 417/440 |
| 5,173,034 | 12/1992 | Riffe | 417/312 |
| 5,238,370 | 8/1993 | Diflora | 417/312 |
| 5,435,700 | 7/1995 | Park | 417/312 |
| 5,507,151 | 4/1996 | Ring et al. | 417/312 |

*Primary Examiner*—Timothy Thorpe
*Assistant Examiner*—Peter G. Korytnyk
*Attorney, Agent, or Firm*—Darby & Darby

[57] ABSTRACT

In a compressor there is a hermetic case (1) having a high pressure gas outlet (1*a*) that houses a cylinder block (3) defining a gas suction chamber (7) and a gas discharge chamber (8). A main gas discharge tube (9) has an inlet end (9*a*) in fluid communication with the gas discharge chamber (8) and an outlet end (9*b*) communicating the gas discharge chamber (8) with the gas outlet (1*a*) of the case. At least one gas discharge auxiliary tube (10) is provided with an inlet end (11) receiving gas from the discharge chamber (8) and an outlet end (12) to provide the gas to the gas stream flowing in the main gas discharge tube. Each discharge auxiliary tube (10) has a length corresponding to a fraction, or multiple, of the wave length of a frequency of a gas pulsation signal at the gas discharge chamber outlet and produces at its gas outlet end (12) where it mixes with the gas from the main discharge tube, a modification in the phase of a determined frequency of said gas pulsation signal to reduce the intensity of this signal at the gas outlet (1*a*) of the hermetic case (1).

5 Claims, 2 Drawing Sheets

DISCHARGE ARRANGEMENT FOR A HERMETIC COMPRESSOR

FIELD OF THE INVENTION

The present invention refers to a new constructive solution applied to the discharge tube of a reciprocating hermetic compressor of the type used in small refrigeration systems.

BACKGROUND OF THE INVENTION

Reciprocating hermetic compressors usually consist of a motor-compressor assembly mounted within a hermetically sealed case.

These compressors are usually provided with a cylinder and a reciprocating piston, which takes in and compresses the refrigerant gas when driven by an electric motor. The piston actuation causes an intermittent flow of refrigerant gas which tends to produce noise, requiring the provision of acoustic dampening systems in the suction and in the discharge sides of the compressor.

Among the known techniques for noise dampening, mainly those occurring at the discharge side of the compressor, we can mention the use of discharge acoustic filters or mufflers, in which the compressed gas coming from the compressor is expanded, reducing the pressure of the latter. Such solution, however, results in energy losses with a consequent reduction of the compressor efficiency, besides allowing the heat to dissipate through the block, altering the suction flow in the cylinder. The superheating substantially reduces the volumetric capacity of the compressor, reducing the filling capacity thereof.

Moreover, acoustically efficient discharge mufflers have relevant restrictions in relation to the gas flow, altering the operating characteristics of the compressor and directly affecting its efficiency.

The compression in reciprocating compressors generates pressure components in several different frequencies. The pressure signals (pulsation) are propagated through the gas flow and may excite acoustic resonances in the discharge muffler, structural resonances in the discharge tube or, when the compressor is mounted in a refrigeration system, may provoke vibrations in the inlet tube of the condenser. All these situations cause a substantial increase in the noise radiated by the compressor and also in the circuit to which the latter is connected for operation, such as a refrigeration system.

While some of the known solutions for reducing the levels of pulsation (pressure), such as by modifying the design of the discharge valves, valve seats, stops, discharge mufflers, discharge tubes or also by adequately selecting the positioning of the discharge outlet tube, minimize the above cited problems, said solutions can only be applied (with a relatively simple implantation) during the design phase of the product. The implantation of these solutions in already existing products, mainly those obtained from automated production lines, may require important changes in the manufacturing process.

DISCLOSURE OF THE INVENTION

Thus, it is a general object of the present invention to provide a discharge arrangement for a reciprocating hermetic compressor which overcomes the above cited deficiencies, allowing to obtain a reduction in the transmission of acoustic energy to the discharge of said compressors, without altering the efficiency thereof.

It is a further object of the present invention to provide a discharge arrangement for a hermetic compressor, which allows to obtain the above cited noise reduction with a simple implantation solution for mass production and for already operating compressors, without significantly changing the manufacturing process of said compressors.

These and other objectives are attained through a discharge arrangement for a hermetic compressor of the type having a hermetic case comprising a high pressure gas outlet and housing a cylinder block defining gas suction and gas discharge chambers; a gas discharge tube, having an inlet end in fluid communication with the gas discharge chamber and an opposite end communicating the gas discharge chamber with the gas outlet of the case, said arrangement further comprising at least one gas discharge auxiliary tube provided with an inlet end connected to the discharge chamber and an outlet end connected to the gas outlet of the hermetic case, each discharge auxiliary tube having an extension corresponding to a fraction of the wave length of a gas pulsation signal and producing, at its gas outlet end, a modification in the phase of a determined frequency of said gas pulsation signal, in order to reduce the intensity of this signal at the gas outlet of said hermetic case.

The solution of the present invention allows to obtain a reduction between 30 and 40 dB in the pulsation signal at the outlet of the hermetic case, with a simple and easy-to-implement construction, since it is applied in a compressor component which is easy to handle and which does not cause any alteration in the compressor efficiency.

Variations of temperature only displace the syntony in the frequency of the wave propagated through the discharge tube.

BRIEF DESCRIPTION OF THE DRAWING

The invention will be described below, with reference to the attached drawings, in which.

BEST MODE OF CARRYING OUT THE INVENTION

Figure 1:
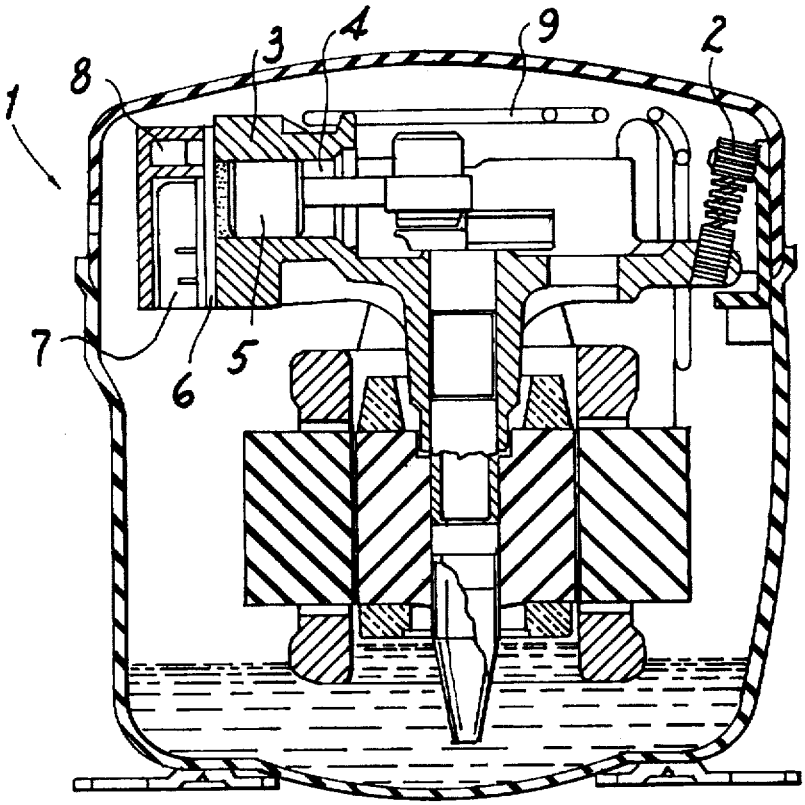
Fig. 1 (PRIOR ART)
FIG. 1 shows, schematically and in a median vertical section view, a compressor of the type used in the present invention.
Figure 2:
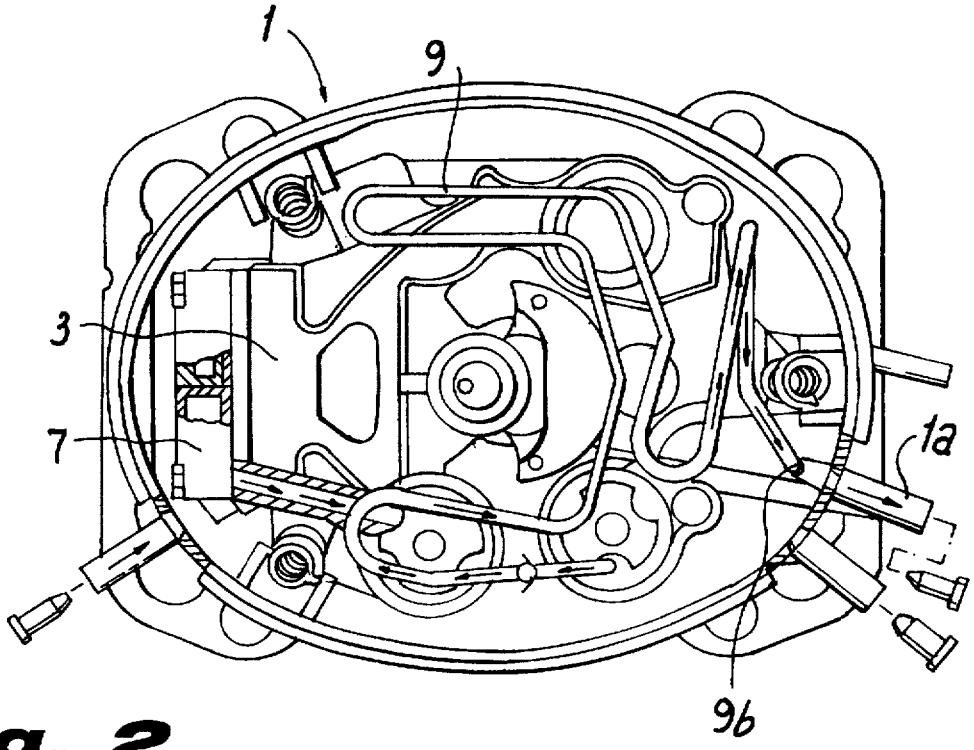
Fig. 2 (PRIOR ART)
FIG. 2 shows, schematically and in a partially cut top plan view, the compressor as illustrated in FIG. 1, from which the upper portion of the case was removed.

According to FIGS. 1 and 2, the compressor used in the present invention comprises a hermetic case 1, inside which there is suspended, through springs 2, a motor-compressor assembly including a cylinder block 3, in which a cylinder 4 lodges a reciprocating piston 5, moving alternatively within said cylinder 4, taking in and compressing the refrigerant gas when driven by the electric motor.

Cylinder 4 has an open end which is closed by a valve plate 6 mounted to said cylinder block 3 and provided with suction and discharge ports. Said cylinder block 3 further supports a cylinder head mounted to said valve plate 6 and defining, internally and with the latter a suction chamber 7 and a discharge chamber 8, which are maintained in a selective fluid communication with cylinder 4, through the respective suction and discharge ports. This selective communication is defined by the opening and closing of said suction and discharge ports by the respective suction and discharge valves.

The hermetic case further comprises a discharge tube 9 having an end 9*a* communicating with the discharge chamber 8 and an opposite end 9*b* opened to a port provided on the surface of the hermetic case 1 communicating said discharge chamber 8 with the high pressure side of a refrigeration system to which the compressor is connected. The opposite end 9*b* of the discharge tube 9 is affixed to a discharge outlet tube 1*a* mounted to the port provided in the hermetic case 1.

In the prior art construction illustrated in FIG. 1, the gas compressed in cylinder 4 is directed to the discharge chamber 8 upon the opening of the discharge valve mounted on the valve plate 5 and is then conducted to the high pressure side of the refrigeration system through the discharge tube 9, which has, in this construction, a determined length between the cylinder head and the discharge outlet tube 1*a* in the hermetic case 1.

This compressor construction allows pulsations of a determined frequency, resulting from the pressure to which the gas is submitted, to propagate through the discharge side of the compressor, causing the generation of noises which are also transmitted to the hermetic case 1 and heard at the site of the compressor installation.

According to the present invention illustrated in FIGS. 3 and 4, the low frequency noises resulting from gas signals are attenuated by providing the discharge side of the compressor with a discharge tube arrangement, such as described below.

In the present invention, the reduction in the transmission of acoustic energy which is propagated together with the gas flow through the discharge tube 9 is obtained with an active noise control principle, defined by adding a component of the pressure signal propagated through the discharge tube 9, with a modified phase, preferably with an inverted phase, which cancels said pressure signal at a determined specific frequency, which is the main frequency of the pulsation. The component of the signal with inverted phase is obtained from the pressure signal itself existing in the discharge tube or discharge system. The modification in the signal phase is obtained by displacing part of the gas flow coming from the discharge chamber 8, through a gas fluid communication static means, in the form of a gas discharge auxiliary tube 10, whose length corresponds to a fraction of the wave length of the propagating signal to be attenuated. The modification in the phase of the propagating signal may be obtained with a tube or tubes arranged in series and/or in parallel, having different lengths in function of the frequency signal to be attenuated.

Each gas discharge auxiliary tube 10 may be defined in the form of a tube which is plate stamped, with its ends opened to the discharge chamber 8 or to the discharge tube 9 and affixed to said discharge chamber and discharge tube by welding, gluing or by any other adequate fixing means.

According to the present invention, the phase difference is obtained by making part of the wave which is propagating through the auxiliary tube 10 to travel through a trajectory which is longer or shorter than that traveled by the wave being propagated by the discharge tube 9. This difference of trajectory is obtained, in one embodiment of the present invention, by providing the discharge side of the compressor with at least one discharge auxiliary tube 10, whose length differs from the length of the discharge tube 9 by a fraction of the wave length of the pulsation frequency to be attenuated, said fraction being preferably between 0.4 and 0.6 of the wave length and, more preferably, equal to half of the wave length. The interval of the wave length cited above is calculated regarding the alterations in the impedance at the connecting regions between the discharge tubes used and the width of the band of noise frequencies considered.

The determination of the length of the discharge tube or tubes involved is a function of the frequency of the signal to be canceled: higher frequencies i.e., shorter wavelengths require reducing the length of the tubes.

Figure 3:
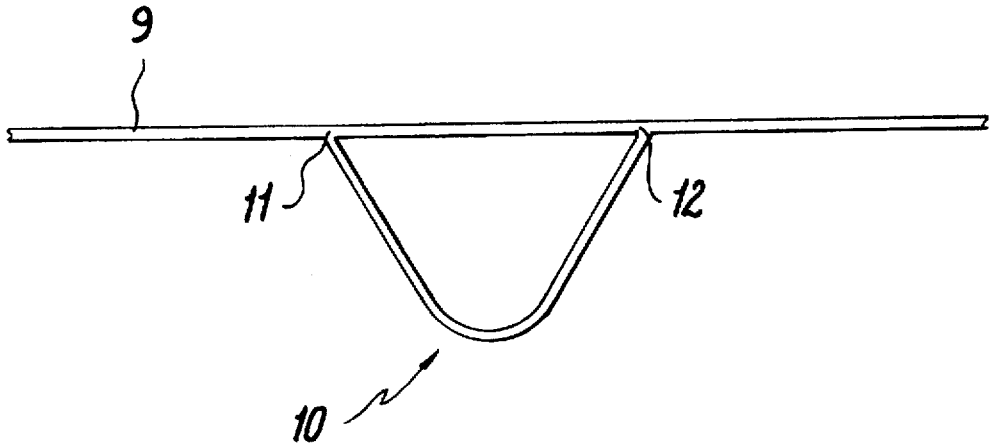
FIG. 3 shows schematically a schematic view of a gas discharge arrangement for a hermetic compressor, according to the present invention.

In a form of carrying out the invention, as illustrated in FIG. 3, the discharge auxiliary tube 10 has a gas inlet end 11 and a gas outlet end 12, each end being connected to a respective portion of the discharge tube 9.

Figure 4:
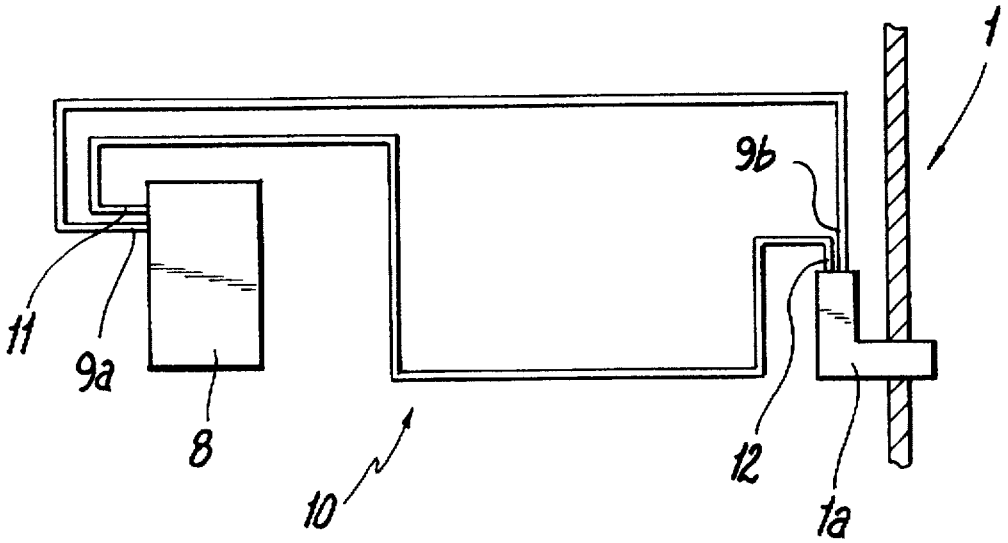
FIG. 4 shows schematically another constructive form of a gas discharge arrangement for a hermetic compressor, according to the present invention.

In another form of carrying out the invention, as illustrated in FIG. 4, the auxiliary tube 10 has its inlet end 11 connected to the outlet of the discharge chamber 8, while its outlet end 12 is connected to the discharge outlet tube 1*a*, such as it occurs with the discharge tube 9. In this construction, the auxiliary tube 10 has a length which exceeds the length of the discharge tube 9 by half of the wave length of the main frequency signal (of gas pulsation) to be canceled before the gas reaches the exterior of the hermetic case 1.

The concept of dampening the frequencies of gas pulsation shown herein may be used for attenuating or canceling other main or secondary frequencies existing in the gas being discharged. The dampening of each frequency may occur by parts, in function of the physical characteristics of the elements used which should be considered when calculating the length of the tube or tube portions provided in communication with portions of the discharge tube or part of the auxiliary tubes used.

We claim:

1. A discharge arrangement for a hermetic compressor comprising:

a hermetic case with a high pressure gas outlet housing a cylinder block defining a gas suction chamber and a gas discharge chamber;

a gas discharge tube having an inlet end in fluid communication with said gas discharge chamber and an outlet end communicating said gas discharge chamber with said case gas outlet;

at least one gas discharge auxiliary tube within said housing having an inlet end communicating with the gas discharged from said gas discharge chamber and an outlet end communicating with said case gas outlet, each said at least one discharge auxiliary tube having a length corresponding to a predetermined part or multiple of the wave length of a gas pulsation signal of a determined frequency at said discharge chamber and producing, at its outlet end a modification in the phase of a determined frequency of said gas pulsation signal to reduce the sound intensity of said gas pulsation determined frequency signal at said case gas outlet.

2. An arrangement as in claim 1, wherein the phase modification introduced corresponds to a multiple of half the wave length of the determined frequency of said gas pulsation signal.

3. An arrangement as in claim 2, wherein a said one of said at least one auxiliary tubes has its inlet and outlet ends connected to said gas discharge tube at spaced locations along the length of said gas discharge tube.

4. An arrangement as in claim 3, wherein the length of said one auxiliary tube is substantially equal to the length of said discharge tube plus an integer which is a multiple of one-half the wave length of said gas pulsation frequency.

5. An arrangement as in claim 1 wherein the said inlet end of a said one of said auxiliary tubes is at said gas discharge chamber and the said outlet end of said one auxiliary tube is at said case gas outlet.

* * * * *

UNITED STATES PATENT AND TRADEMARK OFFICE

CERTIFICATE OF CORRECTION

PATENT NO. : 5,762,479

DATED : June 9, 1998

INVENTOR(S) : Edemar Baars; Edson Correa Miguel

It is certified that error appears in the above-identified patent and that said Letters Patent is hereby corrected as shown below:

In the cover page of the patent, Section [73], as follows:

Delete "S/A - Embarco" and insert therefor --S/A Embraco--.

Signed and Sealed this

Eighteenth Day of August, 1998

Bruce Lehman

*Attest:*

BRUCE LEHMAN

*Attesting Officer*

*Commissioner of Patents and Trademarks*